US011245234B2

(12) United States Patent
Lachelli

(10) Patent No.: US 11,245,234 B2
(45) Date of Patent: Feb. 8, 2022

(54) MULTI-POLE ELECTRIC CONNECTION DEVICE

(71) Applicant: VALENTINI S.R.L., Turin (IT)

(72) Inventor: Guido Lachelli, Rivoli (IT)

(73) Assignee: VALENTINI S.R.L., Turin (IT)

( * ) Notice: Subject to any disclaimer, the term of this patent is extended or adjusted under 35 U.S.C. 154(b) by 0 days.

(21) Appl. No.: 16/982,980

(22) PCT Filed: Feb. 26, 2019

(86) PCT No.: PCT/IT2019/000018
§ 371 (c)(1),
(2) Date: Sep. 21, 2020

(87) PCT Pub. No.: WO2019/180752
PCT Pub. Date: Sep. 26, 2019

(65) Prior Publication Data

US 2021/0028583 A1 Jan. 28, 2021

(30) Foreign Application Priority Data

Mar. 23, 2018 (IT) ..... 102018000003886

(51) Int. Cl.
*H01R 13/6586* (2011.01)
*H01R 13/514* (2006.01)
*H01R 24/86* (2011.01)
*H01R 107/00* (2006.01)

(52) U.S. Cl.
CPC ..... *H01R 13/6586* (2013.01); *H01R 13/514* (2013.01); *H01R 24/86* (2013.01); *H01R 2107/00* (2013.01)

(58) Field of Classification Search
CPC ... H01R 13/6586; H01R 13/514; H01R 24/86
USPC ..... 439/607
See application file for complete search history.

(56) References Cited

U.S. PATENT DOCUMENTS 5,906,513 A * 5/1999 Peterson ..... H01R 13/65912 439/607.58
7,431,619 B2 * 10/2008 Boehnlein ..... G02B 23/2476 439/882
8,241,068 B2 * 8/2012 Millard ..... H01R 13/6461 439/660
8,777,640 B2 * 7/2014 Buck ..... H01R 12/712 439/79
9,293,867 B2 * 3/2016 Rouchaud ..... H01R 24/54
9,450,338 B2 * 9/2016 Reeves ..... H01R 13/631
9,666,985 B2 * 5/2017 Bernardi ..... H01R 13/631
(Continued)

*Primary Examiner* — Alexander Gilman
(74) *Attorney, Agent, or Firm* — Maschoff Brennan

(57) ABSTRACT

A multi-pole electric connection device is described, comprising a multi-pole male electric connection device and a multi-pole female electric connection device, these devices comprising a front capsule comprising a seat inside which a module-holder core is adapted to be inserted, comprising suitable recesses designed to contain contact modules for contacts of an electric type and/or for transporting signals, the front capsule and the module-holder core being made of conductive material to keep a screening between the contacts and to keep unaltered the characteristics of the transmitted signals, these devices being mutually connectable by means of the respective male contacts coupled with the female contacts.

11 Claims, 6 Drawing Sheets

(56) References Cited

U.S. PATENT DOCUMENTS

| | | | | |
|---|---|---|---|---|
| 9,680,268 | B1 * | 6/2017 | Finona | H01R 24/38 |
| 9,728,902 | B2 * | 8/2017 | Hoher | H01R 24/86 |
| 9,814,374 | B2 * | 11/2017 | Kirma | H04N 5/2258 |
| 9,923,288 | B2 * | 3/2018 | Bertrand | H01R 24/86 |
| 10,374,363 | B2 * | 8/2019 | Nolting | H01R 13/648 |
| 10,630,024 | B1 * | 4/2020 | Su | H01R 13/502 |
| 11,114,796 | B2 * | 9/2021 | DeWitt | H01R 13/426 |
| 2006/0258209 | A1 * | 11/2006 | Hall | H01R 24/542<br>439/578 |
| 2007/0259568 | A1 * | 11/2007 | Mackillop | H01R 13/6471<br>439/638 |
| 2012/0238126 | A1 * | 9/2012 | Damodharan | H01R 13/502<br>439/395 |
| 2012/0329323 | A1 * | 12/2012 | Fink | H01R 4/04<br>439/607.01 |
| 2013/0065438 | A1 * | 3/2013 | Nickol | H01R 13/504<br>439/607.01 |
| 2014/0235105 | A1 * | 8/2014 | Friedhof | H01R 9/035<br>439/607.55 |
| 2014/0302724 | A1 * | 10/2014 | Ono | H01R 13/4364<br>439/751 |

* cited by examiner

MULTI-POLE ELECTRIC CONNECTION DEVICE

The present invention refers to a multi-pole electric connection device, comprising an electric contact, of a male or female type, and other electric or optical or opto-electronic contacts.

In particular, the invention refers to a multi-pole electric connection device, comprising a structure made of conductive material designed to contain electrically insulated modules for other electric or optical or opto-electronic contacts.

Multi-pole electric connection devices are known, comprising a structure made of conductive material designed to contain electric or optical or opto-electronic contacts.

These known electric connection devices, however, are not satisfactory and have the problem of not being able to keep thereinside the screening, which is obtained in the cables connected to the connecting device, regarding the external agents and self-produced agents of the same cables inside the structure of the connecting device, with possible interferences in the transmitted signals caused by the fact that, when connecting the cables to the contacts, the cables are physically divided/modeled, modifying their center distances and their shaping (twisting) making them subjected to interferences for the whole passage inside the connecting device.

Documents EP-A1-2 768 086 and US-A1-2013/252465 disclose connecting devices for signal cables according to the preamble of claim 1.

Object of the present invention is solving this problem, by providing a multi-pole electric connection device comprising a structure made of conductive material designed to contain electrically insulated modules for other electric or optical or opto-electronic contacts, said multi-pole electric connection device being designed to keep a screening between the contacts to keep unaltered the characteristics of the transmitted signals, completely insulating the cables connected to the device from any contamination, both environmental, and generated by the cables which share the path inside the connecting device of the invention.

The above and other objects and advantages of the invention, as will result from the following description, are obtained with a multi-pole electric connection device as claimed in the independent claim. Preferred embodiments and non-trivial variations of the present invention are the subject matter of the dependent claims.

It is intended that all enclosed claims are an integral part of the present description.

It will be immediately obvious that numerous variations and modifications (for example related to shape, sizes, arrangements and parts with equivalent functionality) can be made to what is described, without departing from the scope of the invention as appears from the enclosed claims.

The present invention will be better described by some preferred embodiments thereof, provided as a non-limiting example, with reference to the enclosed drawings, in which.

Figure 1:
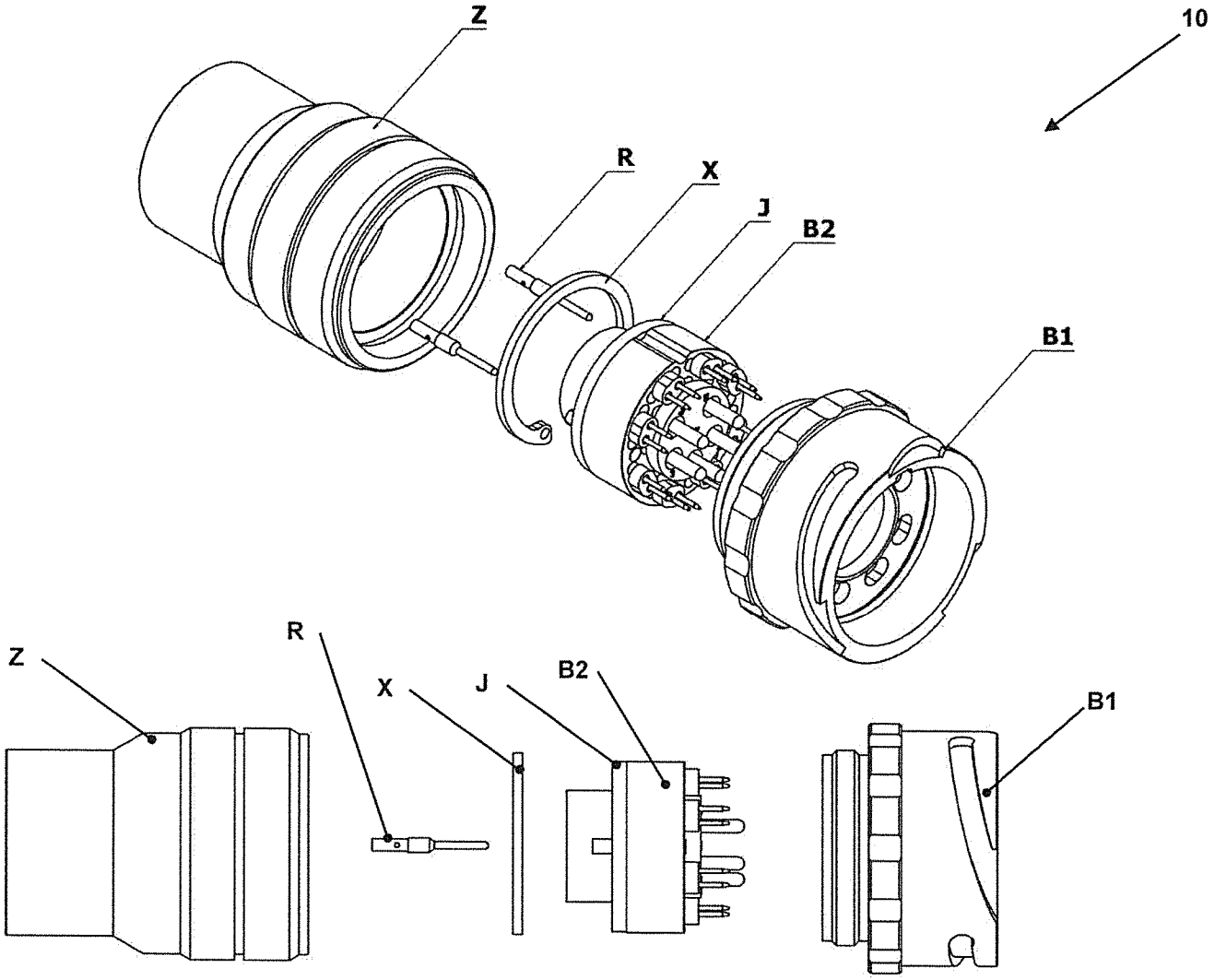
FIG. 1 is an exploded perspective view and a side view of a multi-pole electric connection device of a male type according to the present invention.
Figure 2:
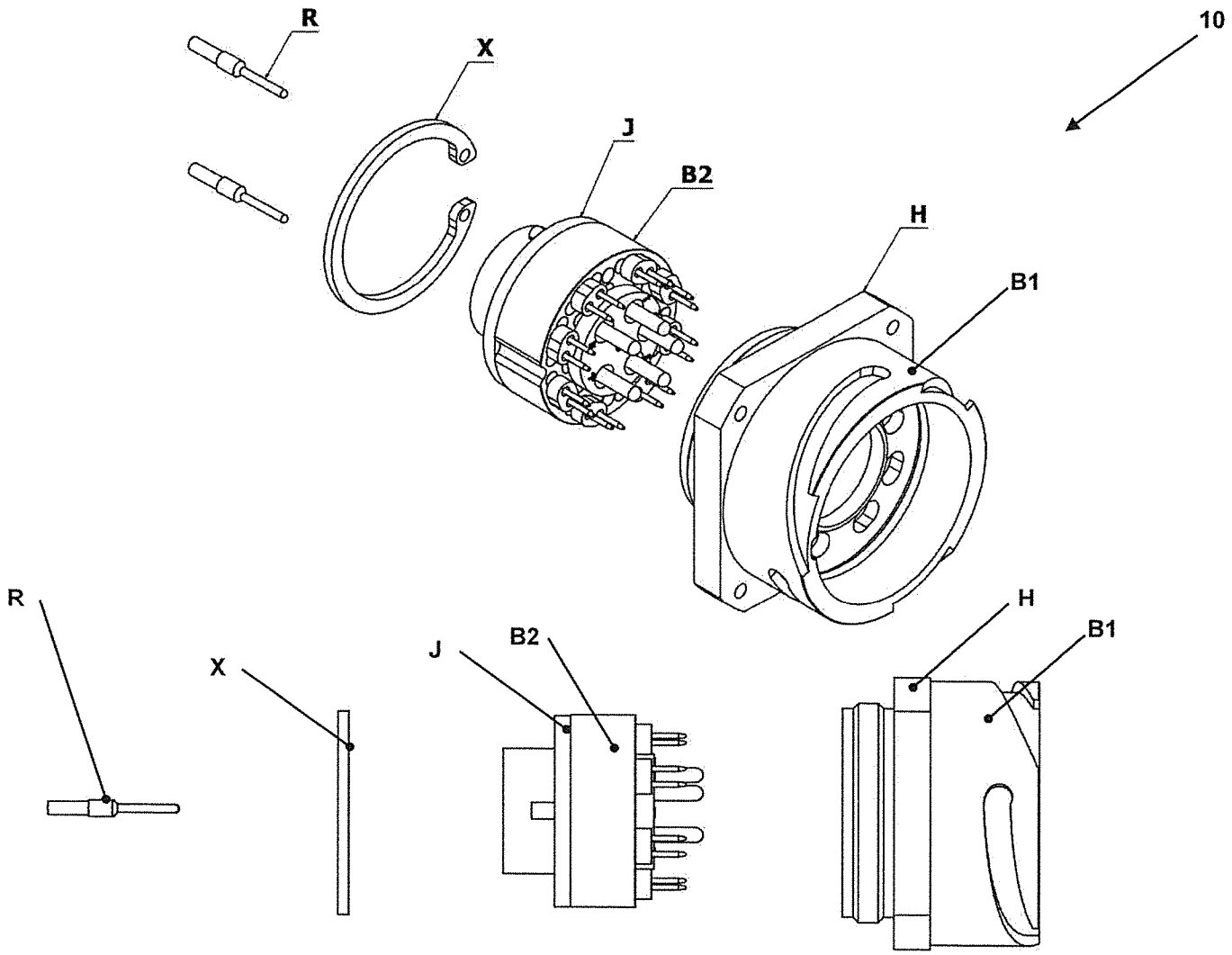
FIG. 2 is an exploded perspective view and a side view of an embodiment of a multi-pole electric connection device of the male type according to the present invention.
Figure 3:
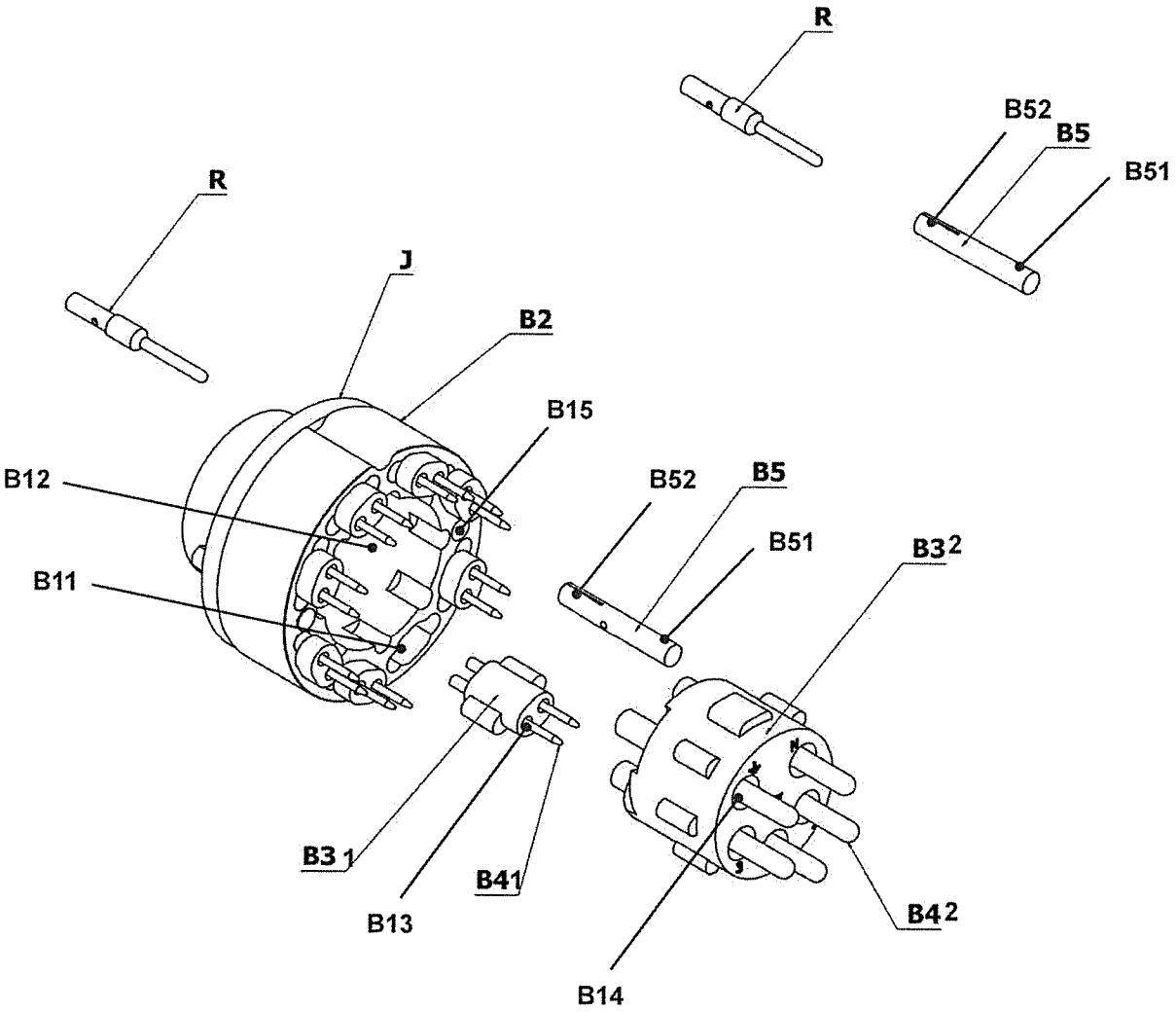
FIG. 3 is an exploded perspective view of a component of a multi-pole electric connection device of the male type according to the present invention.
Figure 4:
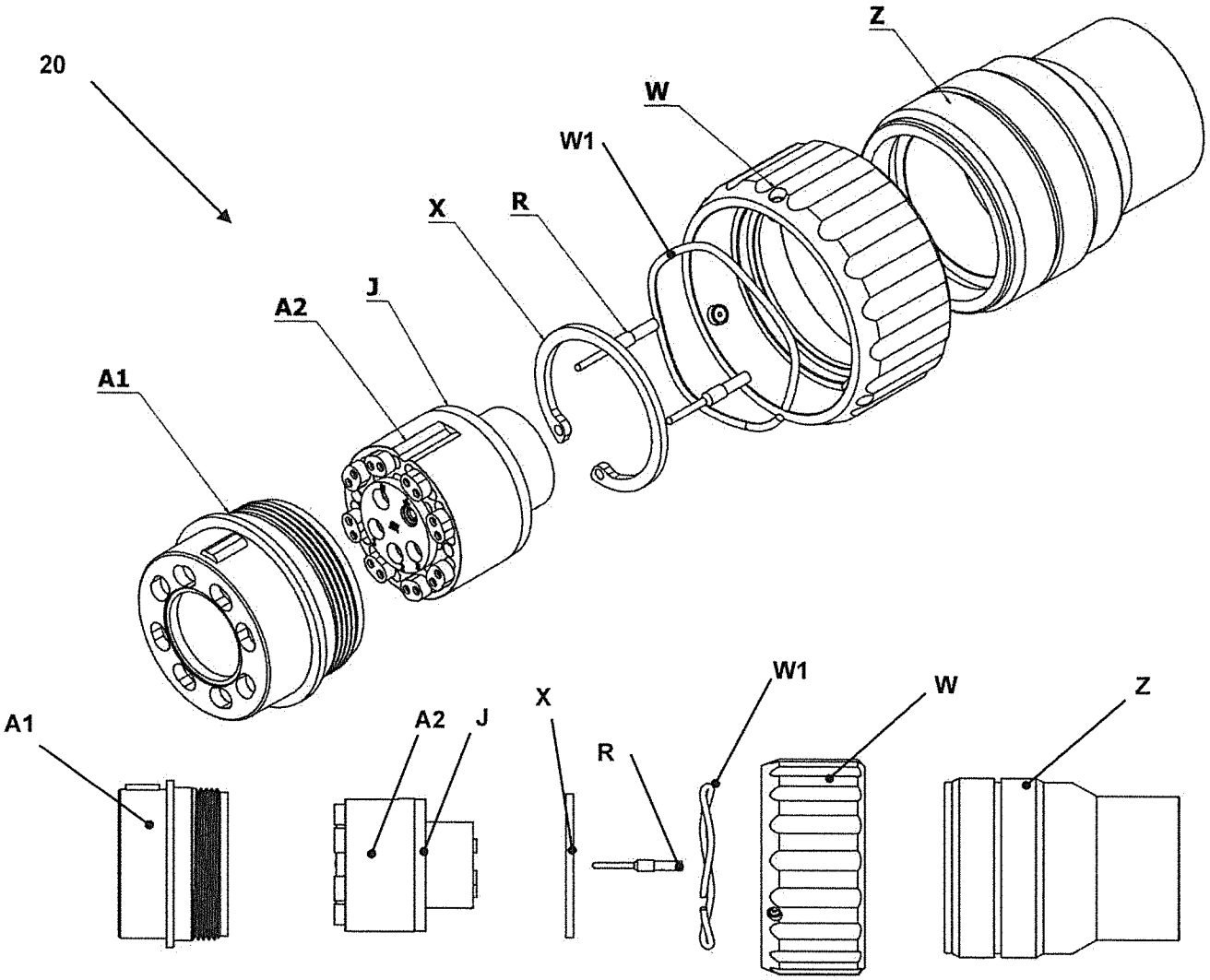
FIG. 4 is an exploded perspective view and an exploded side view of a multi-pole electric connection device of a female type according to the present invention.
Figure 5:
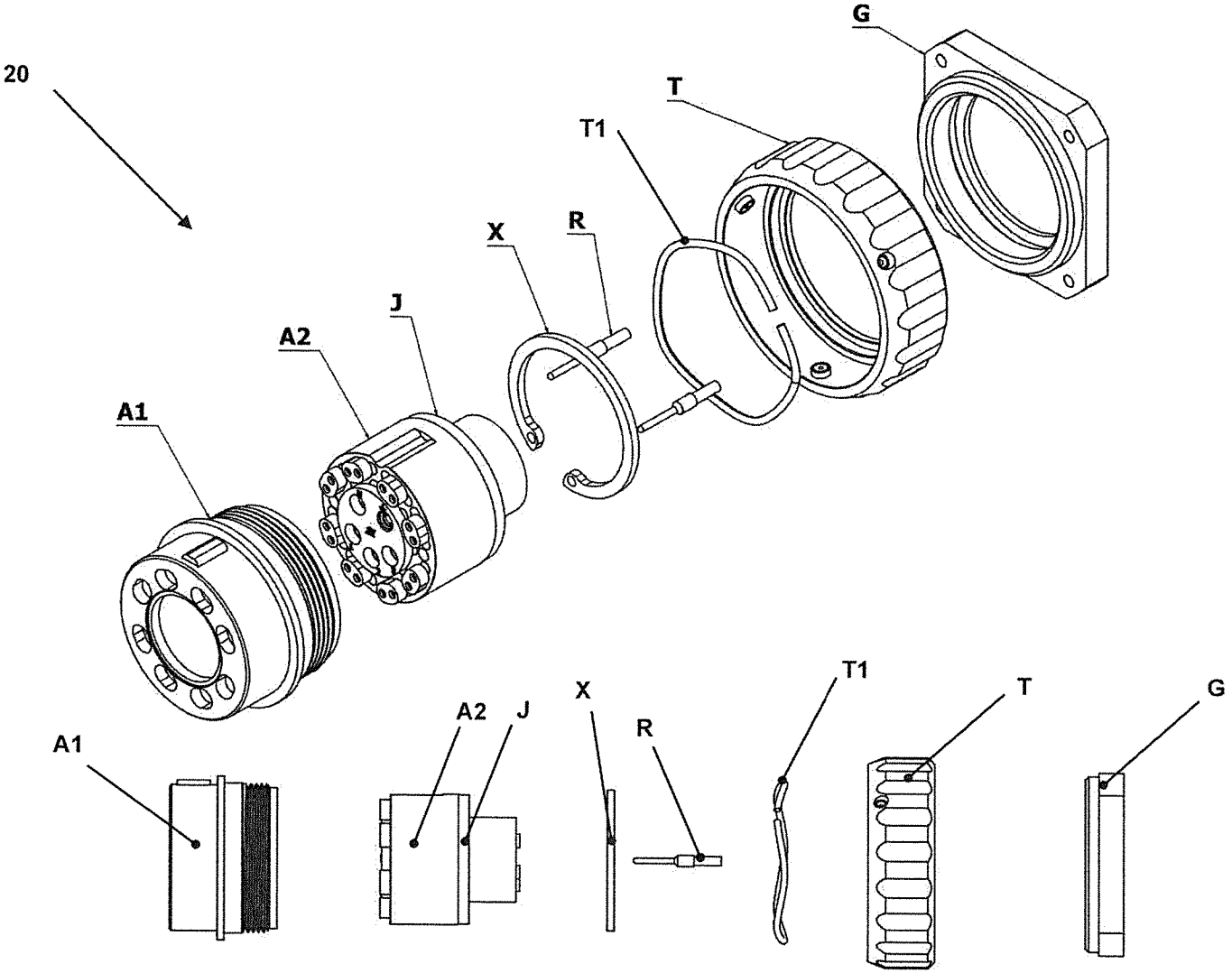
FIG. 5 is an exploded perspective view and an exploded side view of a multi-pole electric connection device of the female type according to the present invention.
Figure 6:
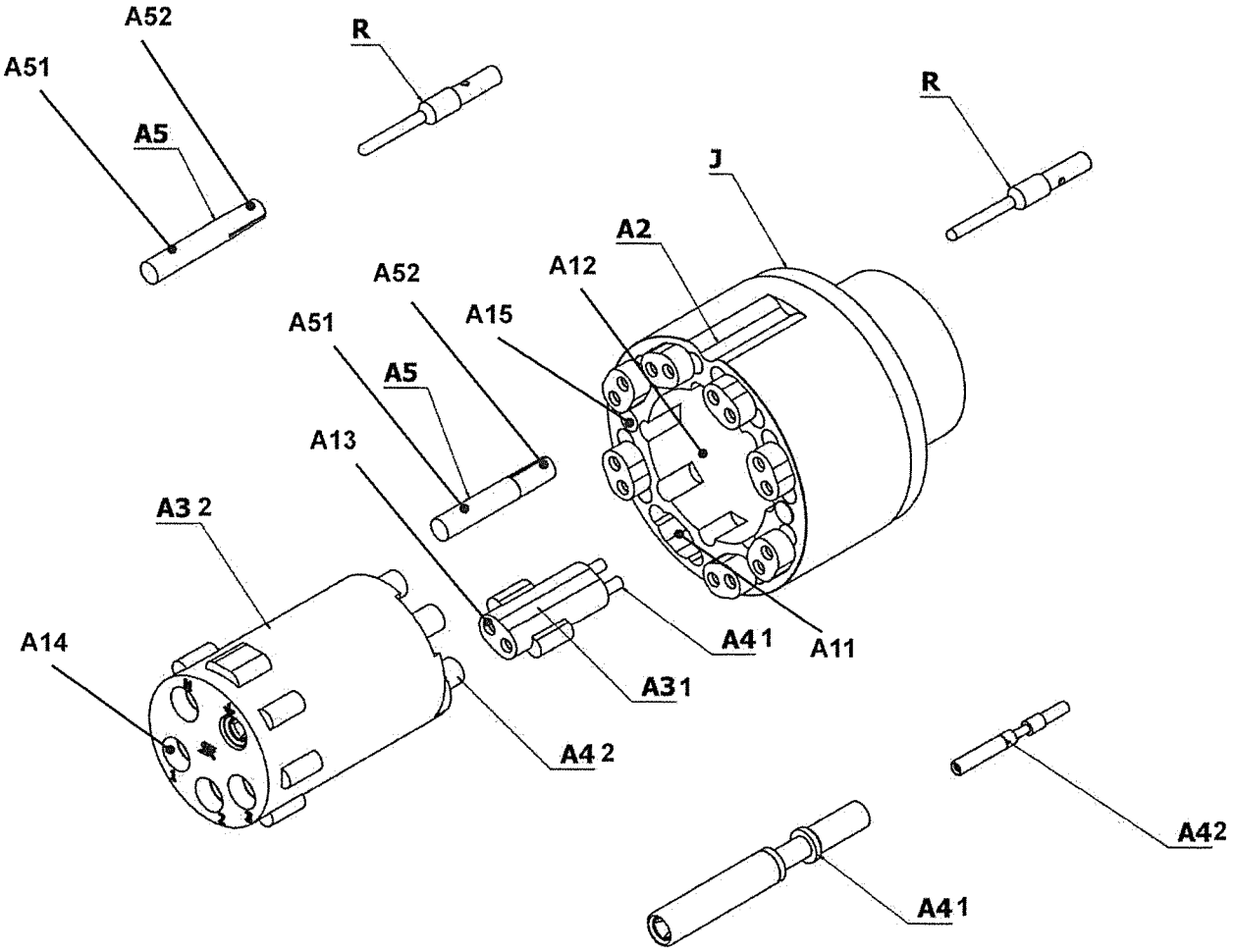
FIG. 6 is an exploded perspective view of a component of a multi-pole electric connection device of the female type according to the present invention.

With reference to the Figures, a preferred embodiment of the multi-pole electric connection device according to the present invention is shown and described.

The multi-pole electric connection device 10, according to the invention comprises a front capsule B1, A1 made of a conductive material, preferably rigid, comprising a seat, preferably with circular section, inside which a module-holder core B2, A2 can be inserted.

In a preferred way, the front capsule B1, A1 is equipped, in the rear part of connecting means, for example a threading, with a wiring fitting and retention element Z; alternatively, the front capsule B1 of the multi-pole electric connection device 10, 20 of the invention comprises a flange H for fastening on a panel.

Preferably, the front capsule B1, A1, comprises, on its external diameter, a seat, for example an undercut, designed to house a fastening element, for example a Seeger spring X, and an optional compensating elastic device J, for example a silicone gasket, to fasten the module-holder core B2, A2 in the front capsule B1, A1.

The module-holder core B2, A2 is composed of conductive material, for example metallic, to keep a screening between the contact inside the connecting device 10, 20 and to keep unaltered the characteristics of the transmitted signals, and comprises suitable recesses B11, B12, A11, A12, designed to contain contact modules B31, B32, A31, A32.

In a preferred way, a first recess B12, A12 is obtained substantially in the central part of the module-holder core B2, A2 and a second recess, preferably a plurality of second recesses B11, A11, are obtained between the first recess B12, A12 and the external edge of the module-holder core B2, A2, preferably su at least one circular crown.

Preferably, the contact modules B31, B32, A31, A32, are made of insulating material and comprise suitable seats B13, B14, A13, A14, composed, for example, of circular holes, designed to contain at least one contact B41, B42, A41, A42 designed to house cables, for example of an electric type or for transporting signals, for example of an optical type.

Preferably, the module-holder core B2, A2, comprises a system for propagating the electric signal between the module-holder core B2, A2 and the front capsule B1, A1 comprising a contact element to keep in contact the module-holder core B2, A2 with the front capsule B1, A1 to perform a screening between the contacts B41, B42, A41, A42 inside the connection device 10, 20 and to keep unaltered the characteristics of the transmitted signals; the system for propagating the electric signal comprises at least one contact element inserted into a through-hole B15, A15 obtained in the module-holder core B2, A2, the contact element being formed of a conductive plug B5, A5 equipped at an end with a projecting head B51, A51 from the module-holder core B2, A2, and at an opposite end with a female terminal B52, A52 designed to house a male contact R to keep in contact the module-holder core B2, A2 with the front capsule B1, A1.

Preferably, the multi-pole electric connection device 10, 20 of the invention comprises a multi-pole male electric connection device 10 and a multi-pole female electric connection device 20, mutually connectable by means of the respective male contacts B41, B42 coupled with the female contacts A41, A42.

In particular, the multi-pole male electric connection device 10 comprises the male front capsule B1 comprising the male module-holder core B2. In turn, the male module-holder core B2 comprises the male contact modules B31, B32, with the male contacts B41, B42, and the contact element B5, R. The multi-pole female electric connection device 20 comprises the female front capsule A1, comprising the female module-holder core A2. In turn, the female module-holder core A2 comprises the female contact modules A31, A32, with the female contact A41, A42, and the contact element A5, R.

In a preferred way, the female front capsule A1 is equipped, in the rear part, with a threading and is housed in a mobile tightening element for a flying contact W.

In a preferred way, the female front capsule A1 equipped in the rear part with a threading is kept in position with respect to the mobile tightening element for a flying contact W by a compensating element W1 for a for a flying contact, for example a saddle spring made of harmonic steel.

In an embodiment of the multi-pole electric connection device 20 according to the invention, the female front capsule A1 is equipped, in its rear part, with a flange G and is housed in a mobile tightening element T.

In a preferred way, the female front capsule A1, equipped in its rear part with the flange G, is kept in position with respect to the mobile tightening element T by a compensating element T1, for example a saddle spring made of harmonic steel.

In a preferred way, the front capsule B1, A1, comprises tightening elements, for example a lock nut W, T with pins adapted to be inserted into a shaped seat or coupled threadings, to perform the tightening and the following mechanical union of the front capsules B1, A1, and therefore of the multi-pole electric connection devices 10, 20, to keep the electric contact between the contacts B41, B42, A41, A42; the tightening elements are further designed to keep the contact between the front capsules B1, A1 and therefore between the module-holder cores B2, A2 of the two devices 10, 20 in order to keep a screening between the contacts B41, B42, A41, A42 to keep unaltered the characteristics of the transmitted signals.

Preferably, the front capsules B1, A1 are mechanically oriented by means of complementary indexing keys to enable their coupling.

Advantageously, the multi-pole electric connection device allows keeping a screening between the contacts to keep unaltered the characteristics of the transmitted signals.

The invention claimed is:

1. A multi-pole electric connection device comprising:

a multi-pole male electric connection device; and a multi-pole female electric connection device, wherein:

said devices include a front capsule having a seat inside which a module-holder core (B2, A2) is adapted to be inserted, including suitable recesses designed to contain contact modules for contacts of an electric type and/or for transporting signals, said front capsule and said module-holder core are made of conductive material to keep a screening between the contacts and to keep unaltered the characteristics of the transmitted signals, said devices are mutually connectable by means of the respective male contacts coupled with the female contacts, the module-holder core includes a system for propagating the electric signal between the module-holder core and the front capsule, including a contact element designed to keep in contact the module-holder core with the front capsule to perform a screening between the contacts and to keep unaltered the characteristics of the transmitted signals, the contact element of the system is adapted for propagating the electric signal being inserted into a through-hole obtained in the module-holder core, the contact element is formed of a conductive plug equipped at an end with a projecting head from the module-holder core, and at an opposite end with a female terminal designed to house a male contact to keep in contact the module-holder core with the front capsule, and the connecting device includes at least one first recess designed to contain contact modules obtained substantially in a central part of the module-holder core and at least one second recess designed to contain contact modules obtained between the first recess and an external edge of the module-holder core.

2. The multi-pole electric connection device according to claim 1, wherein the front capsule is equipped in its rear part with connecting means to a wiring fitting and retention element, or comprises a flange for fastening on a panel.

3. The multi-pole electric connection device according to claim 1, wherein the multi-pole female electric connection device comprises the female module-holder core.

4. The multi-pole electric connection device according to claim 1, wherein the contact modules are made of insulating material and comprise suitable seats designed to contain at least one contact of an electric type or for transporting signals.

5. The multi-pole electric connection device according to claim 4, wherein the front capsule is equipped in its rear part with connecting means to a wiring fitting and retention element, or comprises a flange for fastening on a panel.

6. The multi-pole electric connection device according to claim 1, wherein the multi-pole male electric connection device comprises the male module-holder core.

7. The multi-pole electric connection device according to claim 6, wherein the multi-pole female electric connection device comprises the female module-holder core.

8. The multi-pole electric connection device according to claim 1, wherein the front capsule comprises on its external diameter a seat designed to house a fastening element and an optional elastic device to fasten the module-holder core in the front capsule.

9. The multi-pole electric connection device according to claim 8, wherein the front capsule is equipped in its rear part with connecting means to a wiring fitting and retention element, or comprises a flange for fastening on a panel.

10. The multi-pole electric connection device according to claim 8, wherein the contact modules are made of insulating material and comprise suitable seats designed to contain at least one contact of an electric type or for transporting signals.

11. The multi-pole electric connection device according to claim 10, wherein the front capsule is equipped in its rear part with connecting means to a wiring fitting and retention element, or comprises a flange for fastening on a panel.

* * * * *